US008127827B2

(12) United States Patent
Dunn

(10) Patent No.: US 8,127,827 B2
(45) Date of Patent: Mar. 6, 2012

(54) PROCESS AND APPARATUS FOR DIRECT CHILL CASTING

(76) Inventor: Edmund M. Dunn, Bellevue, WA (US)

( * ) Notice: Subject to any disclaimer, the term of this patent is extended or adjusted under 35 U.S.C. 154(b) by 85 days.

(21) Appl. No.: 12/765,203

(22) Filed: Apr. 22, 2010

(65) Prior Publication Data

US 2010/0269999 A1 Oct. 28, 2010

Related U.S. Application Data

(60) Provisional application No. 61/171,877, filed on Apr. 23, 2009.

(51) Int. Cl.
*B22D 11/049* (2006.01)

(52) U.S. Cl. ..... 164/487; 164/444

(58) Field of Classification Search ..... 164/485–487, 164/443–444

See application file for complete search history.

(56) References Cited

U.S. PATENT DOCUMENTS

| | | | | |
|---|---|---|---|---|
| 4,157,728 | A | 6/1979 | Mitamura et al. | |
| 4,450,893 | A | 5/1984 | Winter et al. | |
| 5,873,405 | A | 2/1999 | Carrier et al. | |
| 6,491,087 | B1 | 12/2002 | Tiak | |
| 6,543,122 | B1 | 4/2003 | Perkins et al. | |
| 7,011,140 | B1 | 3/2006 | Yu et al. | |
| 2011/0073216 | A1 * | 3/2011 | Jossick et al. | 148/23 |

FOREIGN PATENT DOCUMENTS

| | | | |
|---|---|---|---|
| JP | 05093644 | U | 12/1993 |
| JP | 08206789 | A | 8/1996 |
| JP | 2006061939 | A | 3/2006 |
| WO | WO9421405 | A1 | 9/1994 |

* cited by examiner

*Primary Examiner* — Kuang Lin

(74) *Attorney, Agent, or Firm* — AKC Patents LLC; Aliki K. Collins

(57) ABSTRACT

An improved apparatus for direct chill casting of metals includes a mold, a bottom block assembly and a coolant. The mold is configured to surround a molten metal with a mold wall and the mold wall has an outer surface and an inner surface being in contact with the molten metal. The bottom block assembly is arranged at the bottom of the mold and includes a direct chill casting block configured to move away from the mold as the casting forms a solidifying shell of the molten metal. The coolant surrounds the outer surface of the mold wall and is arranged to remove heat away from the molten metal via the inner surface of the mold wall. The outer surface of the mold wall has a circumferential groove filled with a brazing alloy.

16 Claims, 3 Drawing Sheets

PROCESS AND APPARATUS FOR DIRECT CHILL CASTING

CROSS REFERENCE TO RELATED CO-PENDING APPLICATIONS

This application claims the benefit of U.S. provisional application Ser. No. 61/171,877 filed Apr. 23, 2009 and entitled "IMPROVED PROCESS AND APPARATUS FOR DIRECT CHILL CASTING", the contents of which are expressly incorporated herein by reference.

FIELD OF THE INVENTION

The present invention relates to direct chill casting of metals, and more particularly to and improved process and apparatus for direct chill casting of aluminum.

BACKGROUND OF THE INVENTION

Most commercial aluminum alloys are produced by the direct chill (DC) casting process. The cast aluminum alloys (ingots) are then processed via hot and/or cold rolling into sheets or plates. Cylindrical ingots (billets) are often processed into extrusions. In the DC casting process molten aluminum flows into a short, rectangular, or circular water-cooled mold ring, which is initially closed by a plug (called a starter or bottom block) on a movable ram. The molten aluminum freezes against the bottom block and forms a solidifying shell on the mold surface. The ram is then steadily withdrawn, pulling the bottom block and the shell with it. As the shell exits the bottom of the mold, cold water is sprayed directly on it for cooling. In this manner, a cast ingot of a desired length is produced. The DC casting process is a semi-continuous process and is widely used to produce rectangular or cylindrical (billets) ingots which are subsequently rolled into sheet or plate. Billets are subsequently formed into products such as extrusions.

Unfortunately, during the DC casting process a number of defects are introduced, primarily due to the non-uniform, high rate of heat removal imparted by the direct contact of the bottom block or flowing water with partially solidified ingot. These defects increase the cost and reduce the yield of the DC casting process.

Accordingly, it is desirable to control the heat removal process and thereby to reduce the extent of surface defects. Of specific interest in this invention is the freezing of the meniscus at the top of the melt.

SUMMARY OF THE INVENTION

An improved process and apparatus for direct chill casting of aluminum includes cutting a circumferential groove into the water side of the aluminum ring mold and filling it with brazing alloy. This reduces the thermal conductivity locally, opposite the critical melt meniscus. This fabrication technique avoids the thermal stresses which would be generated if the lower conductivity material were deposited using weld metal.

In general, in one aspect, the invention features an improved apparatus for direct chill casting of metals including a mold, a bottom block assembly and a coolant. The mold is configured to surround a molten metal with a mold wall and the mold wall has an outer surface and an inner surface being in contact with the molten metal. The bottom block assembly is arranged at the bottom of the mold and includes a direct chill casting block configured to move away from the mold as the casting forms a solidifying shell of the molten metal. The coolant surrounds the outer surface of the mold wall and is arranged to remove heat away from the molten metal via the inner surface of the mold wall. The outer surface of the mold wall has a circumferential groove filled with a brazing alloy.

Implementations of this aspect of the invention may include one or more of the following features. The brazing alloy comprises a clad brazing sheet. The apparatus may further include a solid ring being in contact with the brazing alloy and the outer surface of the mold wall. The groove filled with the brazing alloy extends around the entire perimeter of the outer surface of the mold wall or around a portion of the perimeter of the outer surface of the mold wall. The mold comprises a rectangular cross-section and the groove filled with the brazing alloy is arranged in one or more of the mold wall corners. The groove has a thickness in the range of 1/16 inch to 3/8 inch and a height in the range of 1/8 inch to 2 inches. The coolant is water and the water exits a container surrounding the mold via a slot and spays directly onto the solidifying shell of the molten metal.

In general, in another aspect, the invention features an improved method for direct chill casting of metals including the following steps. Providing a mold configured to surround a molten metal with a mold wall. The mold wall includes an outer surface and an inner surface being in contact with the molten metal. Providing a bottom block assembly arranged at the bottom of the mold and comprising a direct chill casting block configured to move away from the mold as the casting forms a solidifying shell of the molten metal. Providing a coolant surrounding the outer surface of the mold wall and arranged to remove heat away from the molten metal via the inner surface of the mold wall. Casting the molten metal is achieved by moving away the direct chill casting block from the bottom of the mold while heat is removed by the coolant through the inner surface of the mold wall, and while the outer surface of the mold wall comprises a groove filled with a brazing alloy.

The details of one or more embodiments of the invention are set forth in the accompanying drawings and description below. Other features, objects and advantages of the invention will be apparent from the following description of the preferred embodiments, the drawings and from the claims.

BRIEF DESCRIPTION OF THE DRAWINGS

Referring to the figures, wherein like numerals represent like parts throughout the several views.

DETAILED DESCRIPTION OF THE INVENTION

Figure 1:
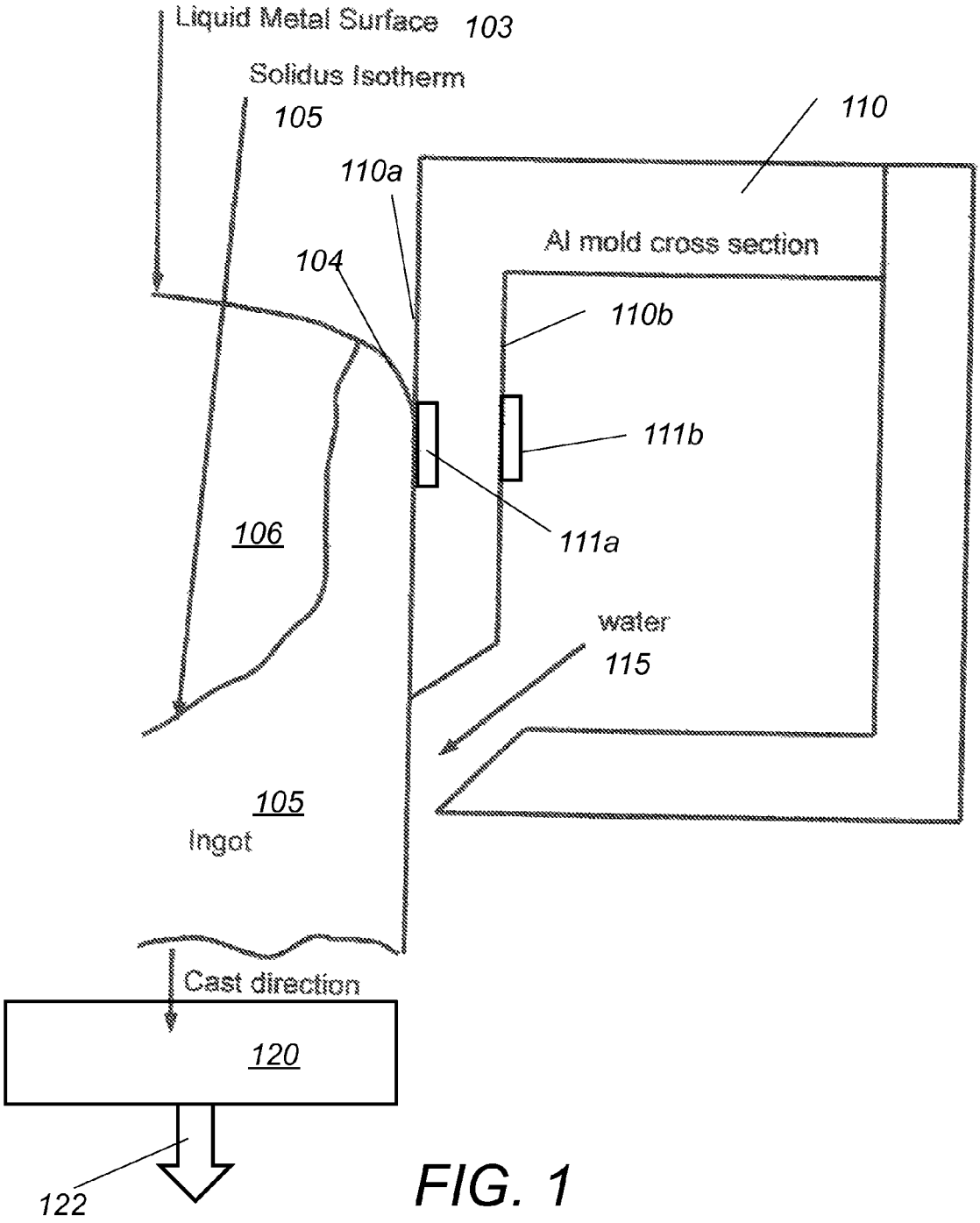
FIG. 1 (prior art)
FIG. 1 is a schematic diagram of a conventional mold.

Referring to FIG. 1, in the direct chill casting process 100, the liquid aluminum melt 102 is contained within a mold ring 110 before it freezes. The mold ring 110 is cooled with water 115 and has a bottom that is initially closed by a plug 120 (also called a starter or bottom block) on a movable ram 122. The molten aluminum 102 freezes against the bottom block 120 and forms a solidifying shell 105 on the mold surface. The ram 122 is then steadily withdrawn, pulling the bottom block 120 and the shell 105 with it. As the shell 105 exits the bottom of the mold ring 110, cold water 115 is sprayed directly on it for cooling. In this manner, a cast ingot of a desired length is produced. The mold ring is usually made of aluminum, stainless steel, copper, or other metal alloys. The mold ring has a circular, rectangular or any other polygonal cross-section corresponding to the desired cross-section of the cast alloy.

Because the heat extraction attributable to the water cooled mold ring is very high, solidification takes place onto the meniscus 104 formed by the liquid metal surface 103 against the mold ring surface 110*a*. This causes the intermittent freezing followed by cascading of liquid metal over the now solid meniscus. The result of this process is an ingot or billet surface with stripes perpendicular to the casting direction. Each of these stripes has a surface groove of roughly ⅛ to ⅜ inches in depth and is associated with undesirable macrosegregation. As shown in FIG. 1, the solidus 105 location is on the meniscus 104 which leads to the intermittent cascading of liquid metal.

A number of different approaches have been used to reduce the heat extraction by the mold ring component and thereby to reduce the surface folds or striations in the ingot. In electromagnetic casting, the mold ring is eliminated entirely. While this approach works, there is a substantial amount of equipment needed to operate the electromagnetic levitation equipment and ring mold. In an alternative approach, air is injected at the mold melt interface (Wagstaff Air Slip Mold). This is effective because the air reduces heat extraction at the interface between the liquid metal surface and the mold ring. In addition, the air may push down the melt and thereby reduces the time the melt is in contact with the mold ring. This approach has been limited to round billet.

Finally, there have been attempts at reducing heat extraction attributable to the mold ring by placing a physically discrete insulating material 111*a* on the molten metal side of the mold wall 110*a*. Examples of this insulting material 111*a* include bands of graphite, stainless steel or some material other than the aluminum mold. These approaches have problems because of the high thermal resistance of the interfaces between the solid band and the solid aluminum mold. Furthermore, band materials such as stainless steel or graphite have a different thermal expansion coefficient than the aluminum mold and this causes the bands to overheat and break during the casting process. The high thermal resistance of the interfaces coupled with the differential thermal expansion resulted in failure of the casting system. In the case of a graphite band, wear of the graphite limits the life of the system. When significant wear of the graphite has taken place, a step or ridge develops at the bottom edge of the graphite. The newly frozen ingot can catch and tear at this location. Another difficulty with this approach is that the solid-solid contact leads to excessive temperatures around the mold-melt interface. This causes the oil lubricating the mold-melt interface to evaporate and results in surface tears. This can also result in the unacceptable condition in which the ingot becomes stuck in the mold and intermittently breaks free. This problem was recognized and addressed in U.S. Pat. No. 4,450,893, where a thermal insulating layer 111*b* was placed on the coolant side 110*b* of the casting mold wall. However, they failed to address the problems created by adding a heat transfer resistant interface between the layer of a foreign material 111*b* and the mold 110. The solid-solid interface between the band material and the mold does not provide a good "intimate" contact. There is always an air gap formed between the two solid materials due to surface unevenness. This air gap causes problems with the heat transfer at the interface of the two solid materials.

Figure 2:
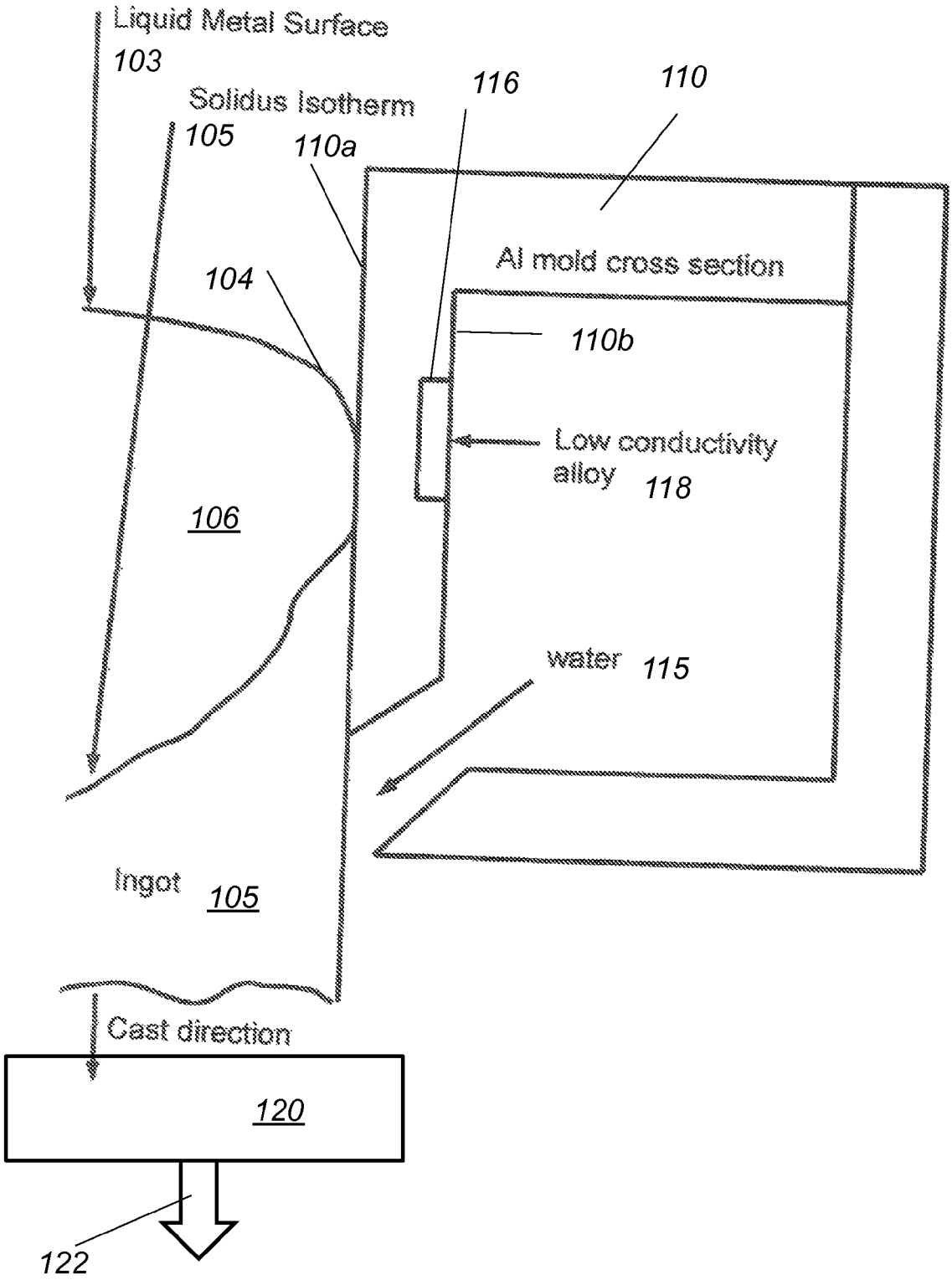
FIG. 2 is a schematic diagram of mold according to this invention.

Referring to FIG. 2, in as improved apparatus of the present invention a groove 116 is made in the water-side 110*b* of the aluminum DC casting mold 110. This groove 116 is filled with weld metal having a lower conductivity than the mold. This approach was successful in creating a much improved cast surface with folds virtually eliminated. Accordingly, it is concluded that a moderate reduction in mold conductivity is effective in improving ingot surface quality. However, this process did have the shortcoming that the deposition of material by welding resulted in significant thermal stresses and associated warping.

In an improved approach, groove 116 is cut into the aluminum ring mold and filled with a brazing alloy 118. The brazing alloy 118 is then heated and brazed into the groove 116, thereby forming a brazed band that has good "intimate" contact with the groove wall. Brazing alloys are used in joining metal parts via a process called brazing. In brazing, the brazing alloy is heated to a temperature above its melting temperature, typically 450° C., while it is protected by an inert atmosphere or flux. The molten alloy is distributed between two close fitting parts by capillary action and it interacts with a thin layer of the base metal (known as wetting) and is then cooled rapidly to form a sealed joint. The melting temperature of the braze alloy is usually substantially lower than the melting temperature of the materials being joined. The filling of the groove with solidified brazing alloy (i.e. brazing) reduces the thermal conductivity of the mold wall locally, opposite to the critical melt meniscus 104 without the creation of thermal stresses associated with the welding deposition of metal. Typical brazing alloys include aluminum-silicon, copper, copper-phosphorous, copper-zinc, gold-silver, nickel alloy, silver, and amorphous brazing foils including nickel, iron, copper, phosphorous, and boron. Aluminum based brazing alloys are especially suitable for this application because the resulting thermal conductivity of the brazed band 118 is only somewhat lower than the thermal conductivity of the aluminum mold. The good "intimate" contact between the brazing alloy 118 and the mold groove wall 116 solves the problem of the air gap formation between the two metals and provides good heat transfer across the interface of the mold wall with the brazing alloy.

Figure 3:
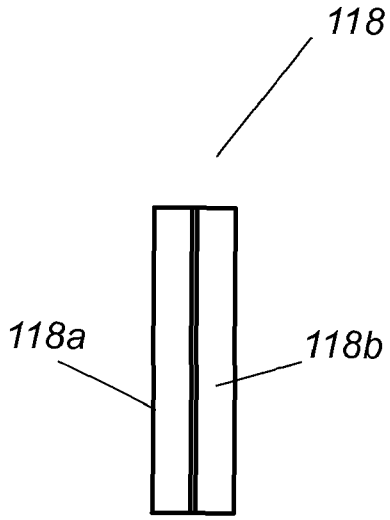
FIG. 3 is a schematic diagram of composite brazing alloy layer 118 of FIG. 2.

An alternative embodiment of the same basic approach is to fill the groove with clad brazing sheet which has a wrought alloy on one side 118*b* and a brazing alloy clad to it on the other side 118*a*, as shown in FIG. 3. The invention utilizes a small amount of insulation and eliminates the air gaps associated with the solid-solid interface between the solid ring and the mold. Close contact between the insulator and the mold is achieved by using the brazing alloy. As shown in FIG. 2, the addition of an insulating layer 118 lowers the solidus 105 near the ingot surface which removes it from the meniscus 104 eliminating the associated ingot surface quality problems.

In summary, the surface quality of an aluminum ingot or billet is significantly improved by casting it as shown in FIG. 2. This process applies to all aluminum alloys produced by the direct chill or DC process. The main features of this design are a groove 116 on the water side 110*b* of the mold 110 which is subsequently filled with low conductivity brazing alloy 118. This brazing alloy 118 has lower thermal conductivity than the balance of the mold 110 but not so low as to cause other problems. This process is applicable to the casting of aluminum sheet/plate ingot and round billet. The thickness of the groove is between 1/16 inches and ⅜ inches. The height of the groove is between ⅛ inches and 2 inches. The groove 116 extends around the entire circumference of the mold.

Figure 4:
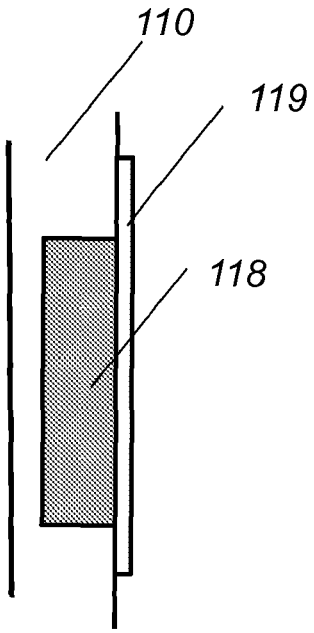
FIG. 4 is a schematic diagram of a combination of a brazing alloy and a ring structure.
Figure 5:
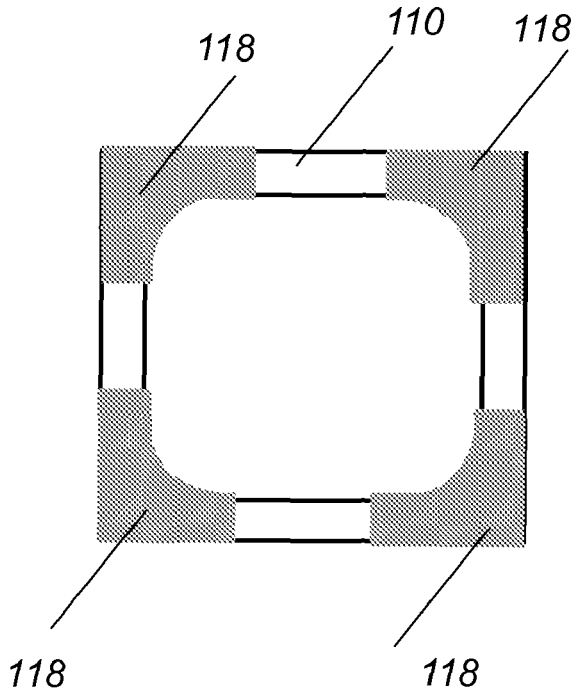
FIG. 5 is a cross-section top view of a rectangular mold with brazing alloy in its corners.

In another embodiment, the brazing alloy 118 is located in the groove between the mold and a solid ring 119, as shown in FIG. 4. In other embodiments a clad sheet or a soldering alloy substitutes for the brazing alloy. In yet another embodiment the groove does not extend around the entire circumference of the mold. In this embodiment, the corners of the rectangular mold ring are preferentially insulated with the grooved/layer since they are most susceptible to meniscus freezing, as shown in FIG. 5.

Several embodiments of the present invention have been described. Nevertheless, it will be understood that various modifications may be made without departing from the spirit and scope of the invention. Accordingly, other embodiments are within the scope of the following claims.

What is claimed is:

1. An improved apparatus for direct chill casting of metals comprising:

a mold configured to surround a molten metal with a mold wall, said mold wall comprising an outer surface and an inner surface being in contact with the molten metal;

a bottom block assembly arranged at the bottom of the mold and comprising a direct chill casting block configured to move away from the mold as the casting forms a solidifying shell of the molten metal;

a coolant surrounding the outer surface of the mold wall and arranged to remove heat away from the molten metal via the inner surface of the mold wall; and wherein said outer surface of the mold wall comprises a groove filled with a brazing alloy.

2. The apparatus of claim 1, wherein said brazing alloy comprises a clad brazing sheet.

3. The apparatus of claim 1, further comprising a solid ring being in contact with the brazing alloy and the outer surface of the mold wall.

4. The apparatus of claim 1, wherein said groove filled with said brazing alloy extends around the entire perimeter of the outer surface of the mold wall.

5. The apparatus of claim 1, wherein said groove filled with said brazing alloy extends around a portion of the perimeter of the outer surface of the mold wall.

6. The apparatus of claim 1, wherein said mold comprises a rectangular cross-section and wherein said groove filled with said brazing alloy is arranged in one or more of said mold wall corners.

7. The apparatus of claim 1, wherein said groove comprises a thickness in the range of 1/16 inch to 3/8 inch and a height in the range of 1/8 inch to 2 inches.

8. The apparatus of claim 1 wherein said coolant comprises water and wherein said coolant exits a container surrounding said mold via a slot or holes and sprays directly onto the solidifying shell of the molten metal.

9. An improved method for direct chill casting of metals comprising:

providing a mold configured to surround a molten metal with a mold wall, said mold wall comprising an outer surface and an inner surface being in contact with the molten metal;

providing a bottom block assembly arranged at the bottom of the mold and comprising a direct chill casting block configured to move away from the mold as the casting forms a solidifying shell of the molten metal;

providing a coolant surrounding the outer surface of the mold wall and arranged to remove heat away from the molten metal via the inner surface of the mold wall;

casting said molten metal by moving away said direct chill casting block from the bottom of said mold while heat is removed by said coolant through said inner surface of the mold wall; and wherein said outer surface of the mold wall comprises a groove filled with a brazing alloy.

10. The method of claim 9, wherein said brazing alloy comprises a clad brazing sheet.

11. The method of claim 9, further comprising placing a solid ring in contact with the brazing alloy and the outer surface of the mold wall.

12. The method of claim 9, wherein said groove filled with said brazing alloy extends around the entire perimeter of the outer surface of the mold wall.

13. The method of claim 9, wherein said groove filled with said brazing alloy extends around a portion of the perimeter of the outer surface of the mold wall.

14. The method of claim 9, wherein said mold comprises a rectangular cross-section and wherein said groove filled with said brazing alloy is arranged in one or more of said mold wall corners.

15. The method of claim 9, wherein said groove comprises a thickness in the range of 1/16 inch to 3/8 inch and a height in the range of 1/8 inch to 2 inches.

16. The method of claim 9, wherein said coolant comprises water and wherein said coolant exits a container surrounding said mold via a slot and sprays directly onto the solidifying shell of the molten metal.

* * * * *